US008013712B2

(12) United States Patent
Cernička

(10) Patent No.: US 8,013,712 B2
(45) Date of Patent: Sep. 6, 2011

(54) OVERVOLTAGE PROTECTION

(75) Inventor: Jozef Cernička, Nitra (SK)

(73) Assignee: KIWA spol, s r.o., Nitra (SK)

( * ) Notice: Subject to any disclaimer, the term of this patent is extended or adjusted under 35 U.S.C. 154(b) by 714 days.

(21) Appl. No.: 11/913,433

(22) PCT Filed: May 3, 2006

(86) PCT No.: PCT/IB2006/001122

§ 371 (c)(1),
(2), (4) Date: Jul. 22, 2008

(87) PCT Pub. No.: WO2006/120522

PCT Pub. Date: Nov. 16, 2006

(65) Prior Publication Data

US 2009/0097183 A1 Apr. 16, 2009

(30) Foreign Application Priority Data

May 4, 2005 (CZ) ..... 2005-283
Aug. 5, 2005 (CZ) ..... 2005-498

(51) Int. Cl.
*H01C 10/50* (2006.01)

(52) U.S. Cl. ..... 338/198; 361/118; 337/142

(58) Field of Classification Search ..... 338/198, 338/13, 21; 361/118–119, 127; 337/5, 142, 337/206, 406

See application file for complete search history.

(56) References Cited

U.S. PATENT DOCUMENTS 5,781,394 A * 7/1998 Lorenz et al. ..... 361/124
5,901,027 A * 5/1999 Ziegler et al. ..... 361/124
5,933,310 A * 8/1999 Eggendorfer ..... 361/104
5,982,597 A * 11/1999 Webb ..... 361/103
6,040,971 A 3/2000 Martenson et al.
6,094,128 A * 7/2000 Bennett et al. ..... 338/21
6,157,528 A * 12/2000 Anthony ..... 361/106
6,211,770 B1 * 4/2001 Coyle ..... 338/21
6,252,488 B1 * 6/2001 Ziegler et al. ..... 337/5
6,307,462 B2 * 10/2001 McLoughlin ..... 338/21
6,430,019 B1 * 8/2002 Martenson et al. ..... 361/124
6,483,686 B1 * 11/2002 Chou ..... 361/118
6,636,403 B2 * 10/2003 McLoughlin et al. ..... 361/103
7,453,503 B2 * 11/2008 Tanaka ..... 348/246

FOREIGN PATENT DOCUMENTS

DE 29519313 U1 3/1996
EP 0436881 A1 7/1991

OTHER PUBLICATIONS

PCT/IB2006/001122 Written Opinion and Search Report Sep. 11, 2006.

* cited by examiner

*Primary Examiner* — Kyung Lee
(74) *Attorney, Agent, or Firm* — Dority & Manning, P.A.

(57) ABSTRACT

An overvoltage protection device includes a slide-in protective member and at least one non-linear resistance element in the slide-in protective member. A cable is connected to the at least one non-linear resistance element by solder, and a sliding member is biased against the cable. The sliding member is capable of reciprocal movement in the slide-in protective member. A visual indicator lever is engaged with the sliding member so that movement of the sliding member moves the visual indicator. A positioning element is engaged with the sliding member so that movement of the sliding member moves the positioning element.

7 Claims, 9 Drawing Sheets

OVERVOLTAGE PROTECTION

FIELD OF THE INVENTION

The invention relates to an overvoltage protection device comprising a bracket and at least one slide-in protective member. The slide-in protective member includes at least one nonlinear resistor element and further comprises a device for disconnecting the nonlinear resistor element from the mains and at least a part of a device for local and/or remote indication of the status of the overvoltage protection.

BACKGROUND

An overvoltage protection device comprises a protective element which is, as a rule, represented by a nonlinear resistor element (varistor) which gradually decreases its resistance value due to applying electric current and pulse loading to the protected mains. In consequence, the current flowing through the protective member increases, and the temperature of the protective member rises. Thus the overvoltage protection is further fitted with a temperature shutdown device. This serves to disconnect the protective member from the mains in the case of reaching a particular temperature of the protective member, because the protective member is not any further able to carry out the function properly due to its temperature rise. Disconnecting the protective member from the mains is indicated either visually directly on the overvoltage protection device or by means of a remote indication. When the protective member is disconnected from the mains, the mains is no longer protected, so it is necessary to renew the status of protection by replacing the overvoltage protection protective member.

The overvoltage protection device generally comprises a U-shaped bracket mounted in a supporting device, and conductors of a protected circuit are connected to the overvoltage protection device, simplifying replacement of the protective element. The overvoltage protection device further comprises a slide-in protective member fitted with contacts for connecting to a current path arranged in the bracket and connected to the protected mains whereas the slide-in protective member is slid into the bracket. Thus, the slide-in protective member is easily replaceable and includes a nonlinear resistor element, a thermal device to disconnect the nonlinear resistor element, a device for visual indication of the status of the overvoltage protection device, and possibly also suitable devices for detecting the status of the overvoltage protection device to remotely indicate the change of the overvoltage protection.

There are many embodiments known, whereas their particular arrangement and used components depend on energy load and impulse current amplitude which passes through the current path of the overvoltage protection. Nowadays used embodiments depend also on manufacturing technologies used at the production of slide-in protective members. Changes in design of slide-in protective members then follow the basic goal of lowering the manufacturing costs with concurrent maintenance of required properties of overvoltage protections.

A well-known device according to Utility Design DE 295 19 313 U1 as a shutdown device of the nonlinear resistor element uses a shaped copper strip which is on one side firmly connected to a contact of the slide-in protective member and on the other side it is connected to a varistor electrode by means of thermally suitable solder. There is a hinged lever acting against the shaped copper strip, where the pressure towards the shaped copper strip is provided by means of a pressure spring which is arranged between the hinged lever and fixed (immobile) shackle of the other end of the spring. The hinged lever serves both for visual indication of the overvoltage protection status change (disconnecting the varistor from the mains) and also for acquiring the information on the status change for the remote indication.

The drawback of this solution is in that it does not allow placing varistors connected in parallel or varistors of bigger sizes, for example, into the bushing of the slide-in protective member due to its space arrangement, which limits variability of the protective properties of this solution while maintaining the outer dimensions of the slide-in protective elements. Another drawback of this solution is the use of a sealing compound for insulation and fixation the varistor in the bushing of the slide-in protective member, which increases the costs.

Another known device according to EP 436 881 A1 utilizes the disconnecting element arrangement perpendicularly to the plane of the varistor. The disconnecting component is a copper strip which is on one side mounted to the contact of the slide-in protective member, and it is connected on the other side to the outlet of the varistor electrode by means of thermally suitable solder. The disconnecting element is arch-shaped, and there is a hole in its centre, into which a hinged lever reaches. The hinged lever forms the necessary action on the disconnecting element by means of the pressure spring, and the disconnecting element, after the solder is melted, moves to the position in which the disconnecting of the varistor from the mains is ensured.

The drawback of this solution is the use of relatively rigid disconnecting element that requires considerable force to deform and which sets decent demands on dimensioning in the system of used components and thus also the solution cost. Another drawback of the solution is the space arrangement of the solution which takes the inner space of the slide-in protective member body up whereas the space can be potentially used for next varistors or for another size of a varistor.

Another known device as a disconnecting element uses a copper strip which is on one of its end connected with the varistor electrode by means of thermally suitable solder. A copper cable connected to its other end is connected to the contact of the sliding member whereas there is a hinged lever reaching into the opening of the disconnecting element. The hinged lever reduces the force against the disconnecting element by means of the pressure spring.

The advantage of this solution is that the copper cable represents a flexible component which needs only a small force to deform, but the drawback of the solution is the increase of the number of components on the current path. This increases the number of connections which are needed to be formed during manufacturing and thus the manufacturing costs are increased.

The goal of the invention is to eliminate or at least to minimize the drawbacks of the today's background art.

BRIEF DESCRIPTION OF THE INVENTION

The goal of the invention has been reached by an overvoltage protection, which principle consists in that there is a sliding member mounted in a body of a slide-in protective member in a reciprocal manner and with a pressure action against a low-melting bond of a cable with an electrode of a nonlinear resistor element. The sliding member is fitted with at least one surface for acting on an visual indicator lever, and it is further fitted with at least one surface for acting on a positioning element of a remote indicator mounted in the bracket.

Advantages of the invention, as well as the principle and advantages of particular preferred embodiments result from the following text.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION

Figure 1:
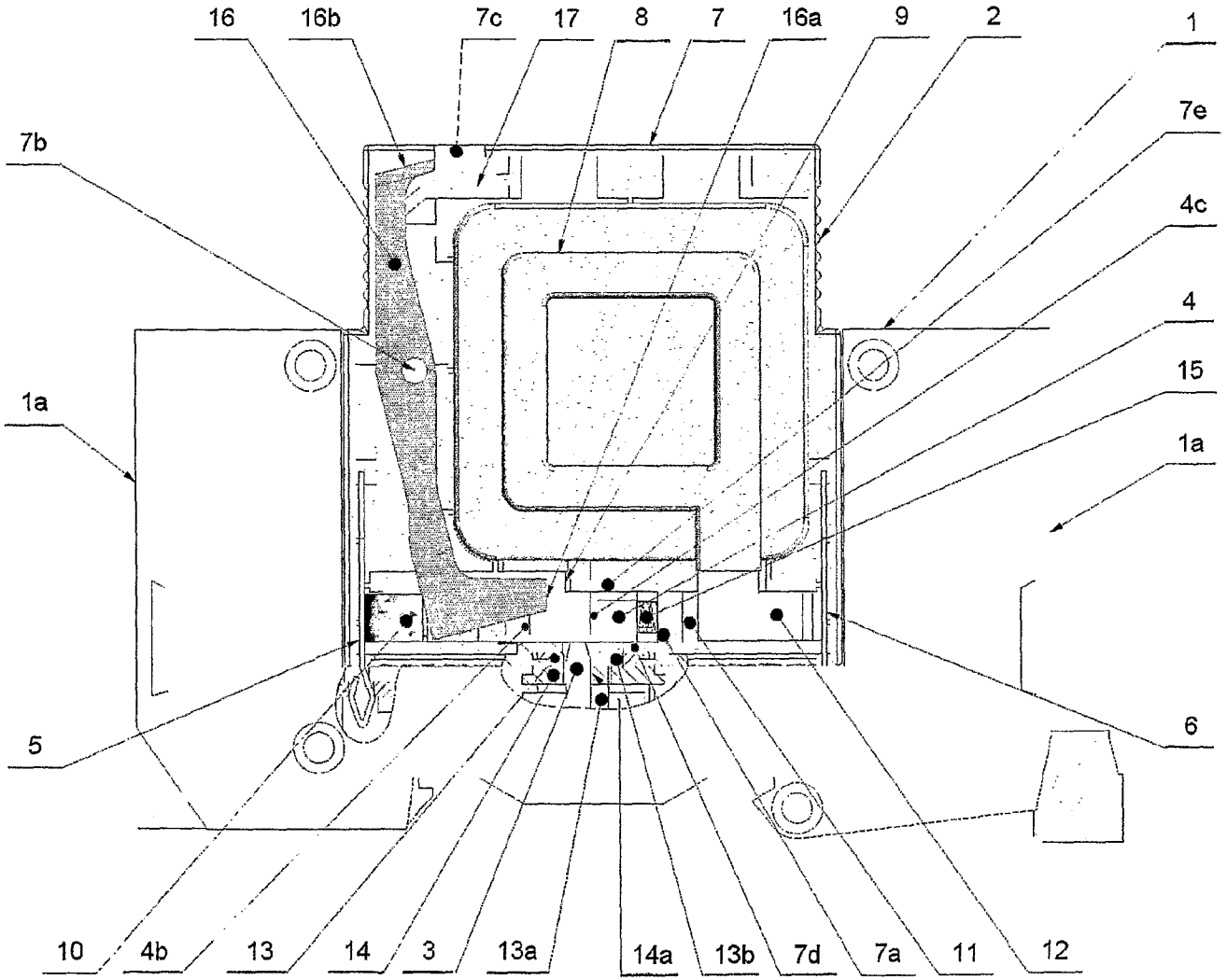
FIG. 1 shows a side plan view of a first embodiment of an overvoltage protection device.
Figure 2:
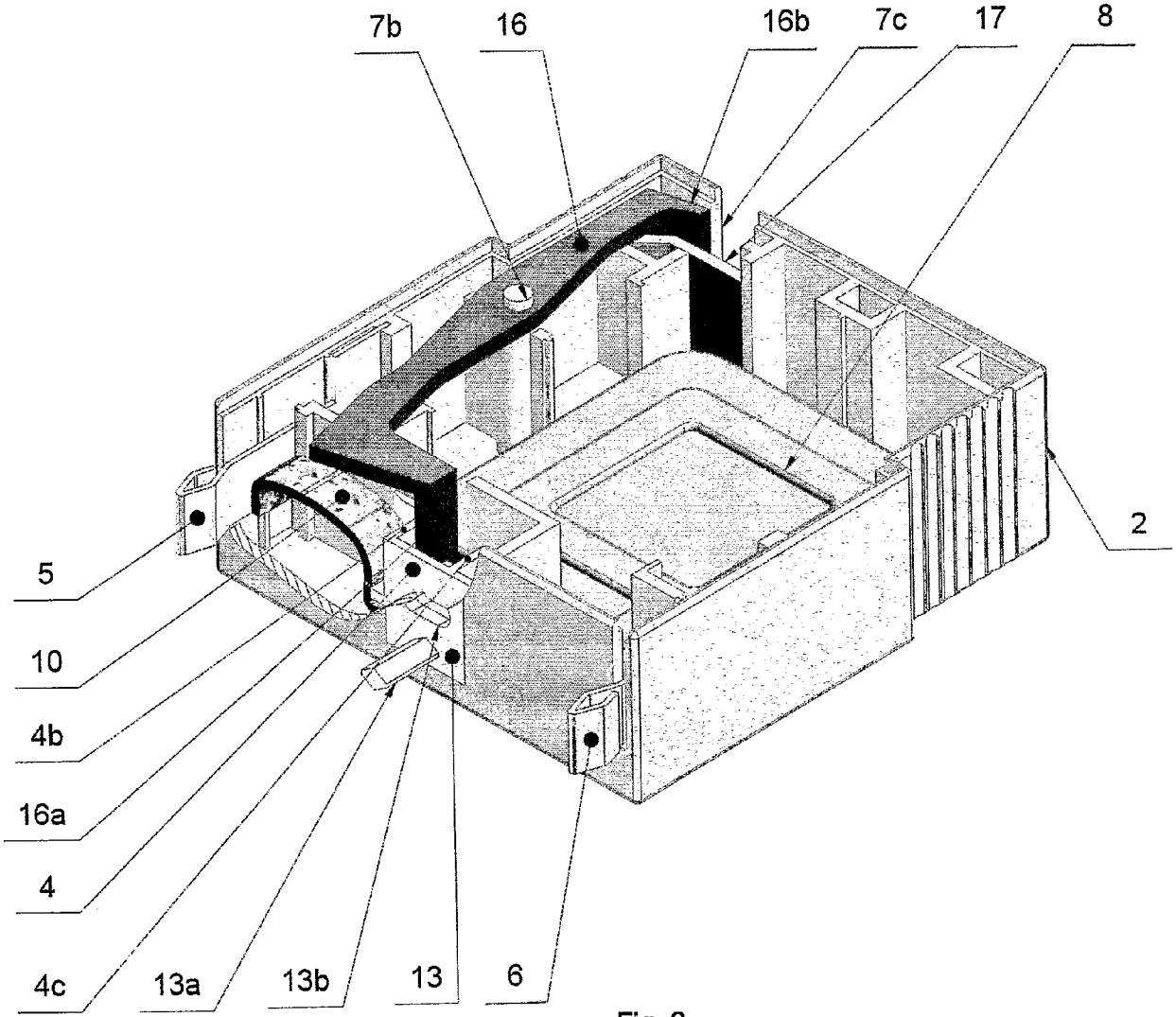
FIG. 2 represents a perspective view of the first embodiment of the overvoltage protection device.
Figure 3A:
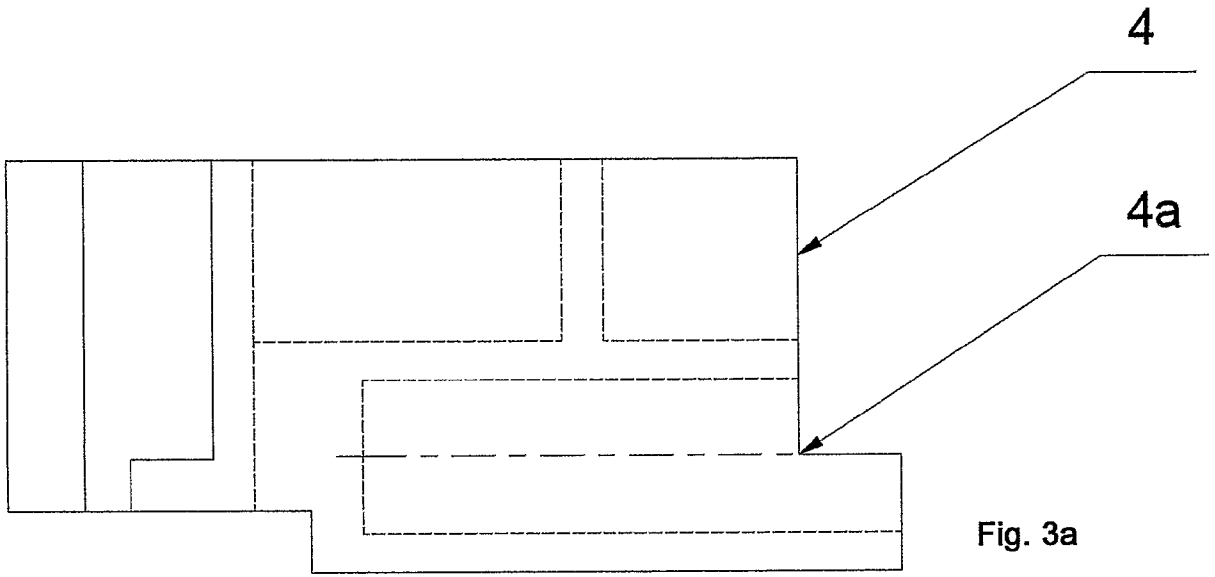
FIG. 3*a* shows a top plan view of a sliding member shown in FIGS. 1 and 2.
Figure 3B:
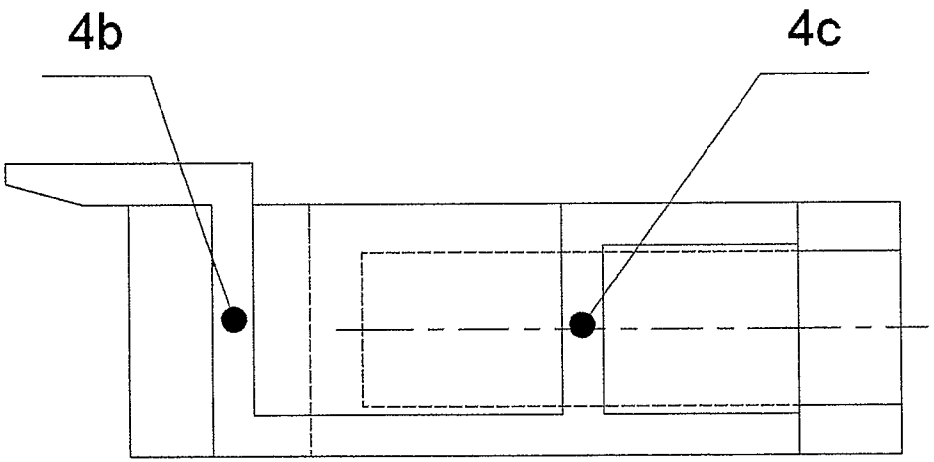
FIG. 3*b* shows a side plan view of a sliding member shown in FIGS. 1 and 2.
Figure 4A:
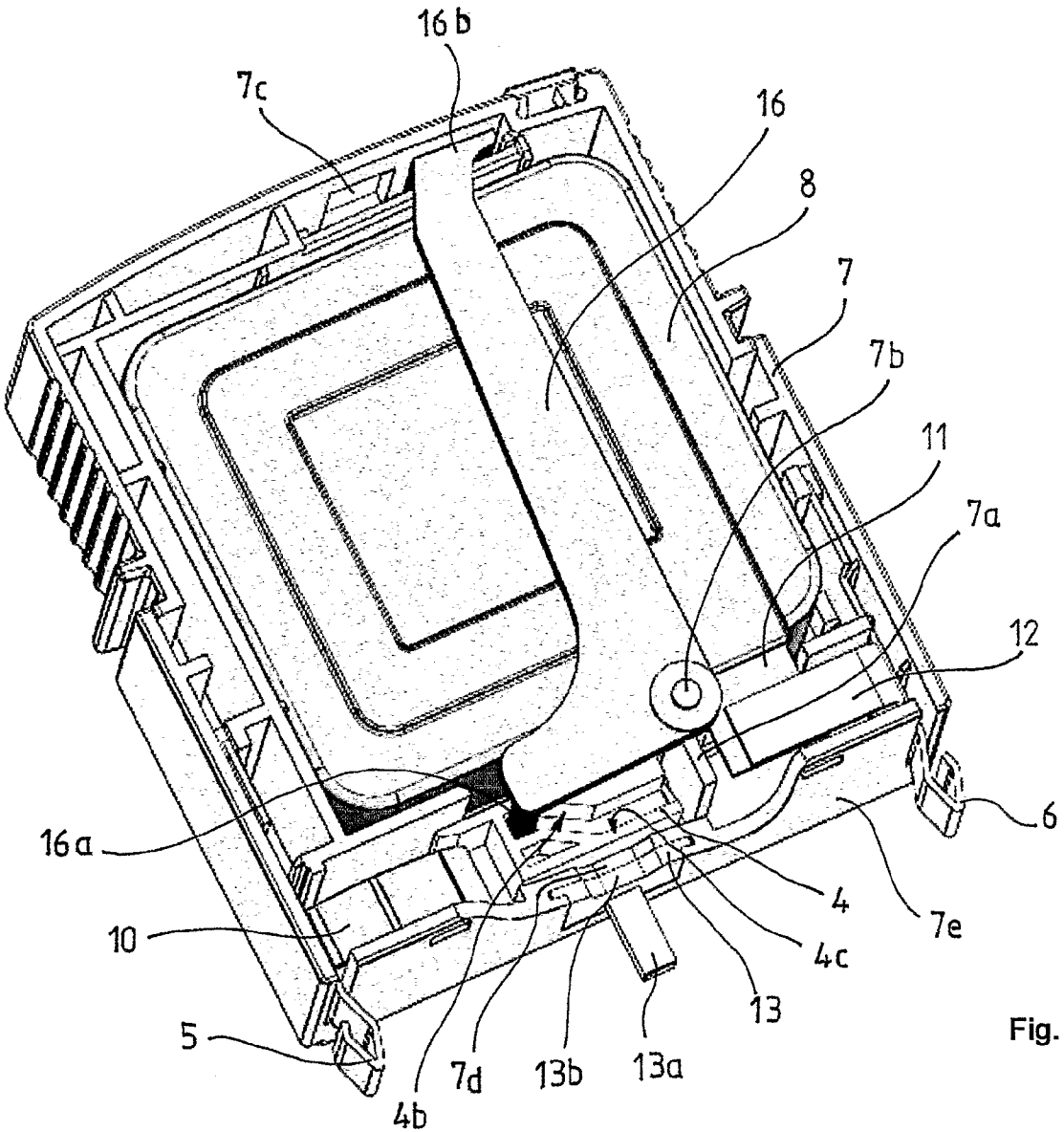
FIG. 4*a* shows a perspective view of a second embodiment of the overvoltage protection device.
Figure 4B:
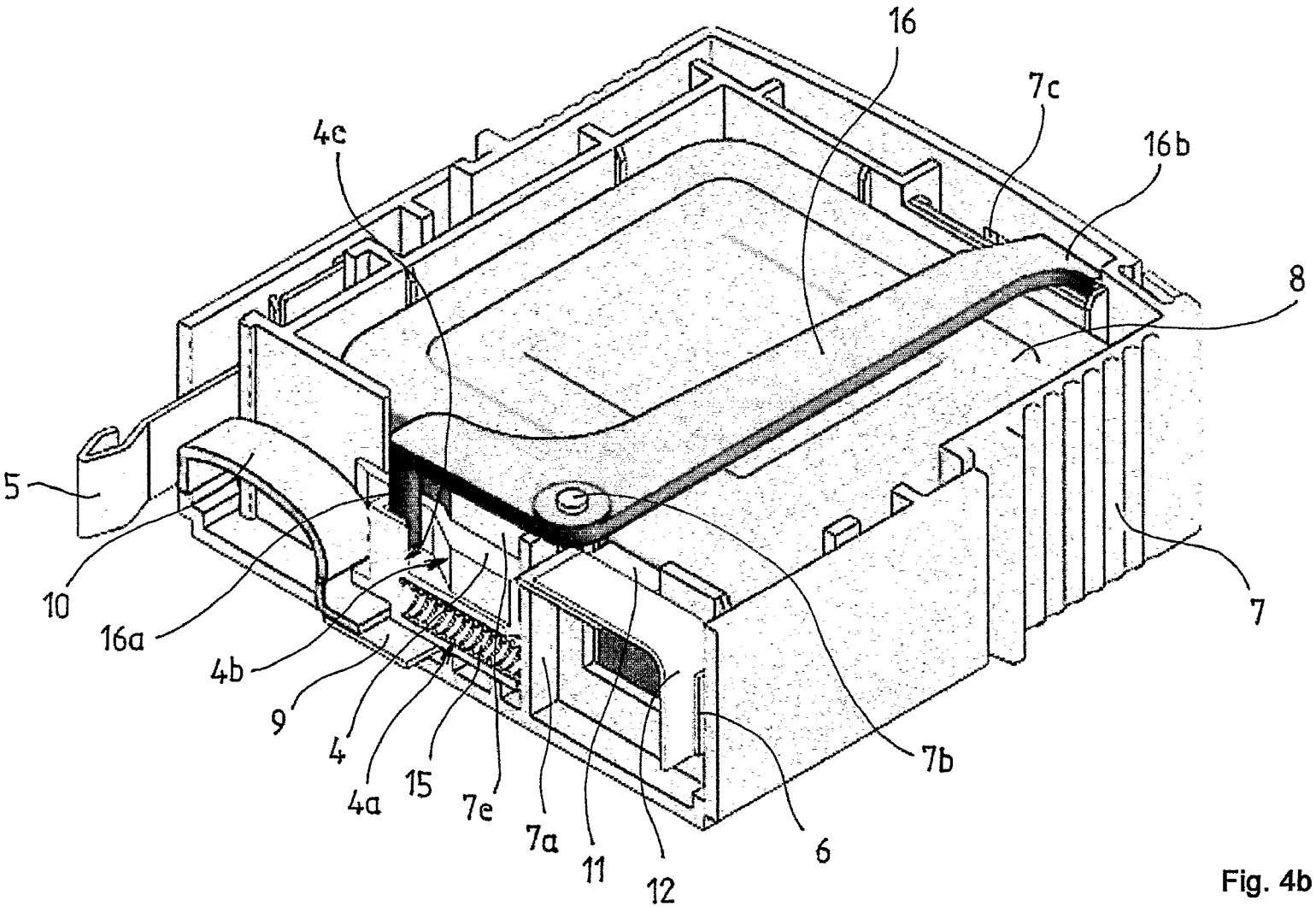
FIG. 4*b* shows a perspective view of the second embodiment of the overvoltage protection device.

An overvoltage protection device includes a bracket 1 in which there is a slide-in protective member 2 mounted in a replaceable manner. There can be a number of slide-in protective members 2 arranged side by side in one bracket 1, for instance for each phase of a three-phase power line etc. Also, a plurality of single-pole brackets 1 can be connected into one assembly, e.g., by means of rivets. The bracket 1 includes terminal connectors in its arms 1*a* and 1*b* for connecting electric wires of the protected circuit. In the bottom part is a pressure spring further comprising a positioning element 3 of the remote indication. The bracket 1 is fitted with devices for mechanically and electrically connecting to the slide-in protective member 2. The bracket 1 is fitted with current paths and contacts, and the slide-in protective member 2 is fitted with contacts 5 and 6 for electrical connection between the slide-in protective member 2 and the bracket 1.

In the body 7 of the slide-in protective member 2, there is at least one nonlinear resistor element connected as a protective member, as an example a varistor 8 or a group of varistors in parallel. An outlet of a bottom electrode 9 of the varistor 8 is connected to one end of a cable 10 by means of a low-melting solder. The cable can be modified to increase its rigidity by welding individual wires forming the cable together. The cable 10 is on its other end connected with a contact 5 of the slide-in protective member 2. The outlet of a top electrode 11 of the varistor 8 is connected to the contact 6 of the slide-in protective member 2, for instance by means of a connecting member 12 which can be either a fixed part of the contact 6 or it can also be a separate component connected to the outlet of the top electrode 11 and to the contact 6.

There is further an indicator 13 mounted in the body 7 with label components 13*a* which reach an indicator 14 on the bracket 1 in the retracted position of the slide-in protective member 2 inside the bracket 1 which confirms the proper arrangement of the bracket 1 and the slide-in protective member 2 or, as the case may be, that there is a slide-in protective member 2 of desired properties slid into the bracket 1.

The slide-in protective member 2 body 7 includes a sliding member 4 mounted in a reciprocal manner. The sliding member 4 is biased directly against the cable 10 by means of a pressure spring 15, thus it acts on the low-melting bond of the cable 10 and the outlet of the bottom electrode 9 of the varistor 8. The pressure spring 15 is in the represented embodiments positioned in a cavity 4*a* of the sliding member 4, and it leans against a wall 7*a* of the slide-in protective member 2 body 7. The sliding member 4 is by means of the connection of the cable 10 and the bottom electrode 9 of the varistor 8 being held in its normal position when the pressure spring 15 is compressed.

Figure 5A:
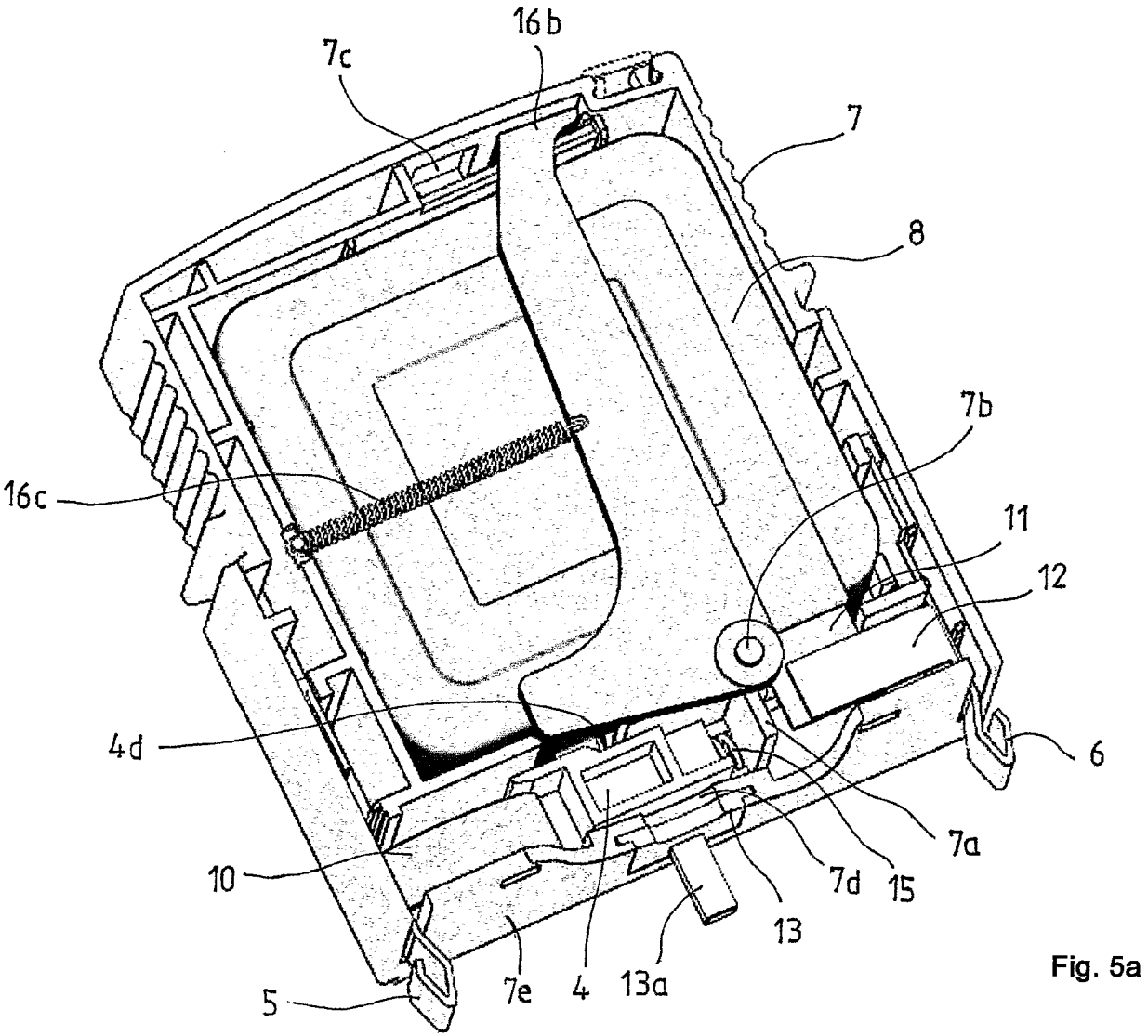
FIG. 5*a* shows a perspective view of a third embodiment of the overvoltage protection device.

In examples shown in FIGS. 1 to 4*b*, the sliding member 4 has slid between its walls 4*b* and 4*c* a bottom arm 16*a* formed on one end of a flat lever 16. The lever 16 is pivoted on a stud 7*b* formed in the body 7 outside the floor surface of the area for the varistor 8 or varistors 8. In the embodiment illustrated in FIGS. 5*a* and 5*b*, the sliding member 4 is fitted with a stepped wall 4*d* instead of walls 4*b* and 4*c*. The bottom arm 16*a* of the lever 16 leans against the stepped wall 4*d*. The bottom arm 16*a* of the lever 16 is in a constant contact with the stepped wall 4*d* of the sliding member 4 maintained by means of a tension spring 16*c*. One of the ends of the tension spring 16*c* is mounted on the body 7, and the tension spring 16*c* is connected with the lever 16 by its other end. The tension spring 16*c* may be replaced by means of a suitably arranged pressure spring.

The lever 16 on its other end includes an indicator arm 16*b* with a coloured spot or coloured surfaces for visual indication of the overvoltage protection status. The body 7 includes a visual indication aperture 7*c*. A spot opposite the visual indication aperture 7*c* or an insert 17 with a colour corresponding to the visual indication in the normal state of the overvoltage protection device is mounted in the body 7 and visible when the indicator arm is not covering the aperture 7*c* in the body 7.

The bottom wall 7*e* of the body 7 and the indicator 13 include oval openings 7*d* and 13*b* through which the above described positioning element 3 passes and leans against the sliding member 4. When the slide-in protective member 2 is slid in the body 1, the positioning element 3 is in the normal position with its end on the sliding member 4, and it displays the overvoltage protection state for the remote indication by means of its position. The shift-aside position for the positioning element 3 (as described further below) is when one of its ends is slid into the body 7 of the slide-in protective member 2. The indicator 13 includes label components 13*a* interlocking into corresponding openings in the bracket 1.

Figure 6B:
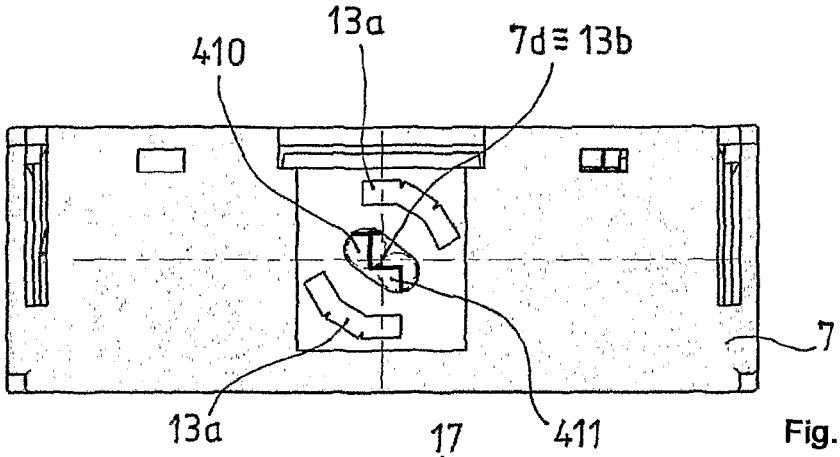
FIG. 6*b* shows a view in the B direction from FIG. 6*a*.
Figure 6A:
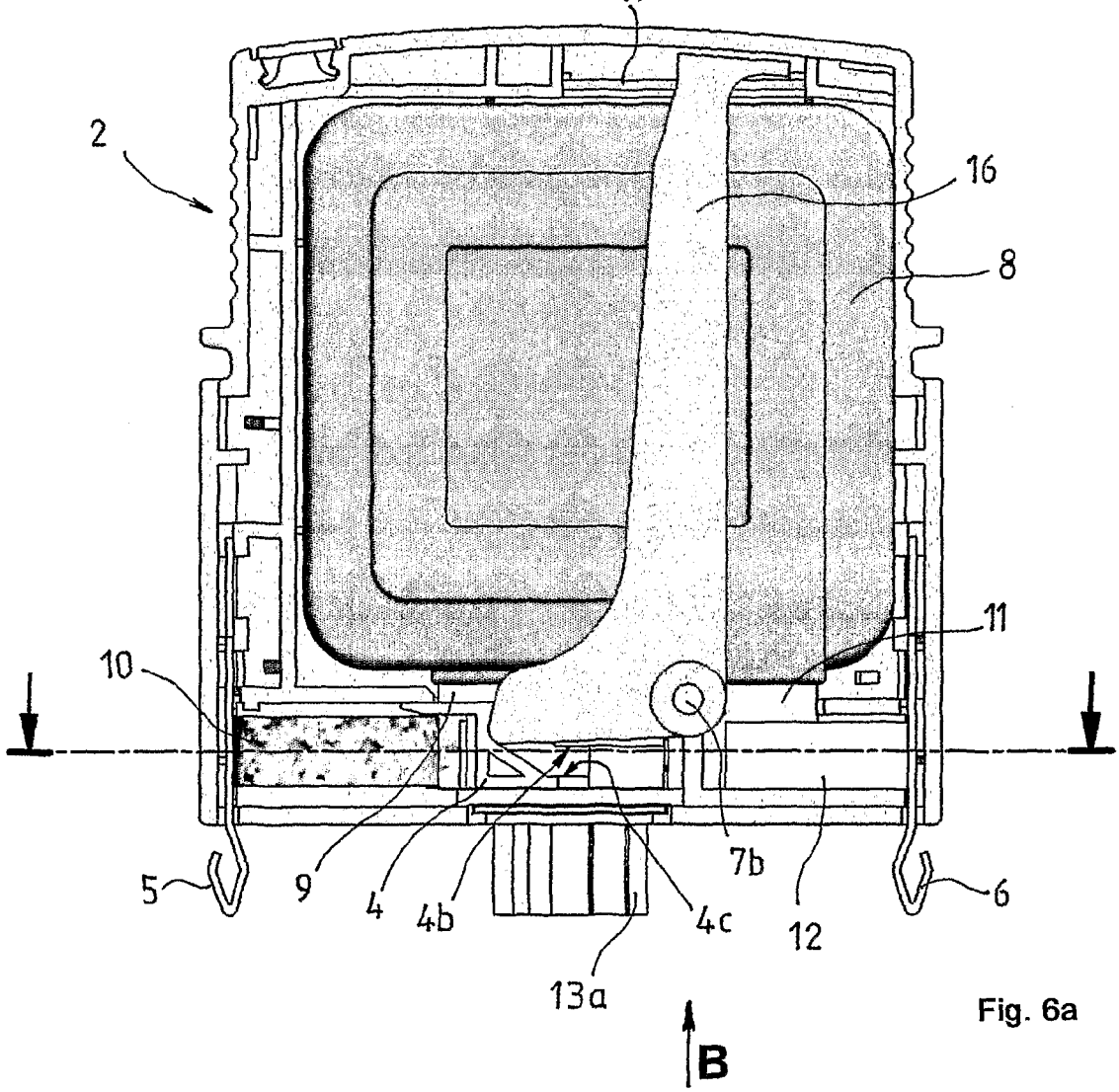
FIG. 6*a* shows a side plan view of an embodiment of a slide-in protective member with a coding device and a device providing turning the slide-in protective member through 180° without affecting its function.
Figure 6C:
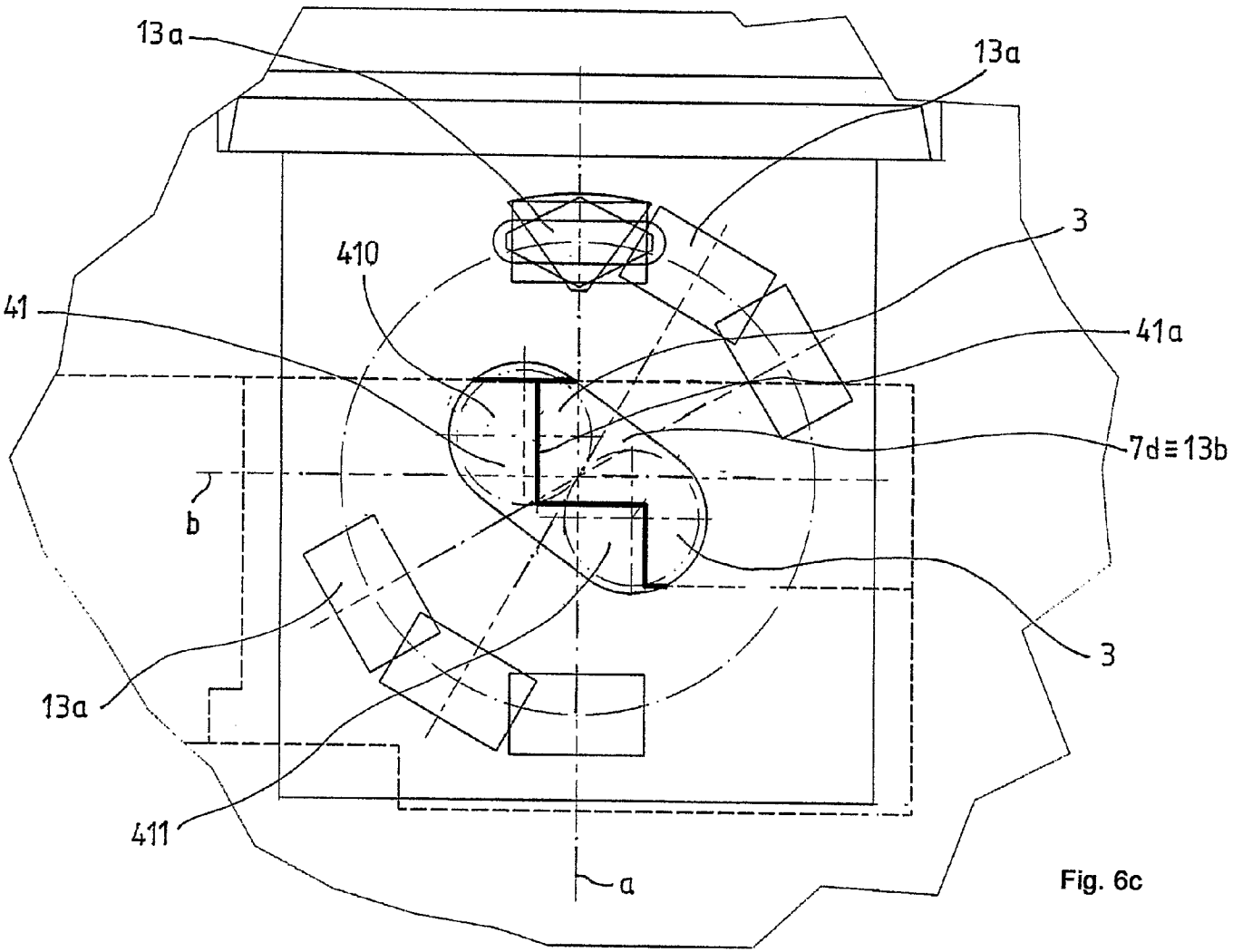
FIG. 6*c* shows a detail of an embodiment of the coding device and the device providing turning the slide-in protective member through 180° without affecting its function.

FIGS. 6*a* to 6*c* show an embodiment enabling turning the slide-in protective member 2 in the bracket 1 through 180° without affecting the protective and indication (remote and visual) function of the slide-in protective member 2. In this embodiment, the positioning element 3 in the bracket is situated outside the symmetry axis a of the contacts 5, 6 or outside the centre of the distance of the contacts 5, 6 and, at the same time, it is situated outside the longitudinal axis b of the slide-in protective member 2. Oval apertures 7*d* and 13*b* are situated sidelong to the axis a and also b. The sliding member 4 includes a retaining wall 41 with a stepped end 41*a* in each part of sidelong oval apertures 7*d* and 13*b*. In the normal position of the sliding member 4, the end of the suspended positioning element 3 thus bears on the first part 410 of the retaining wall 41 of the sliding member 4 in one position of the slide-in protective member 2, whereas the end of the suspended positioning element 3 bears on the second part 411 of the retaining wall 41 of the sliding member 3 in the position of the slide-in protective member 2 turned through 180°. In the shift-aside position of the sliding member 4, both parts 410, 411 of the retaining wall 41 are situated outside the pathway of the suspended positioning element 3 so they do not obstruct its sliding in sidelong oval apertures 7*d* and 13*b* for the remote indication of the overvoltage protection state. On the circle around sidelong arranged oval openings 7*b*, 13*b* are label components 13*a* arranged in angular spacing, and they interlock in both positions of the slide-in protective member 2 (normal and also turned through 180° into the corresponding openings in the bracket 1.

In the embodiments shown in FIGS. 1 to 3*b*, all components of the device for disconnecting the nonlinear resistor element from the mains and all overvoltage protection state indication elements (visual and remote) are inside the body 7 of the slide-in protective element 2 and entirely outside the perimeter of the nonlinear resistor element (varistor 8) in the direction perpendicular to the side surface of the nonlinear resistor element (varistor 8), i.e. in the direction of the body 7 width. In this arrangement, it is possible to place multiple nonlinear resistor elements (varistors 8), connected in parallel next to each other in the direction of the width of the body 7, into one type and size of the slide-in protective member 2 body 7, without the need to adjust the device for disconnecting the nonlinear resistor element from the mains and the device for indicating the overvoltage protection state. If a smaller number of nonlinear resistor elements (varistors 8) are used, then the remaining space of the body 7 between the side wall of nonlinear resistor elements (varistors 8) and the side wall of the body 7 is clear, and there is no component of the device for disconnecting the nonlinear resistor element from the mains or the overvoltage protection state indication elements (visual and remote) reaching the clear space.

Figure 5B:
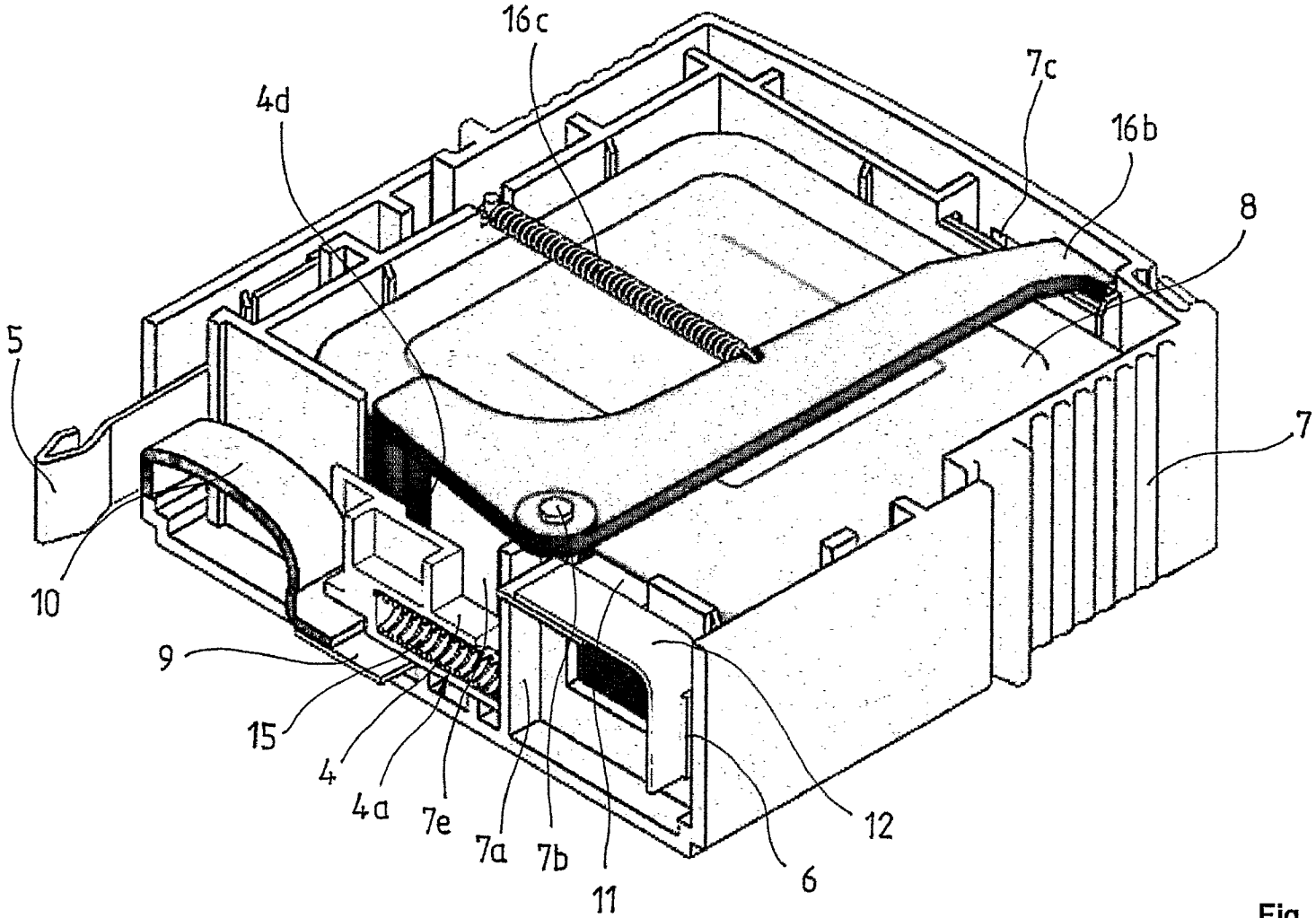
FIG. 5*b* shows a perspective view of the third embodiment of the overvoltage protection device.

In examples shown in FIGS. 4*a* to 5*b*, the stud 7*b*, on which the lever 16 is pivoted, is situated outside the perimeter of the nonlinear resistor element (varistor 8) as viewed from the direction perpendicular to the side surface of the nonlinear resistor element, i.e. in the direction of the body 7 width, whereas the lever 16 is flat in the direction parallel to the side wall of the nonlinear resistor element (varistor 8), and the bottom arm 16*a* and the indicator arm 16*b* are situated outside the perimeter of the nonlinear resistor element (varistor 8) as viewed from the direction perpendicular to the side wall of the nonlinear resistor element (varistor 8), i.e. in the direction of the body 7 width. Also the tension spring 16*c* used in the example in FIGS. 5*a* and 5*b* is situated in the plane parallel to the side wall of the nonlinear resistor element (varistor 8). In the embodiment according to FIGS. 4*a* to 5*b*, it is possible to arrange nonlinear resistor elements (varistors 8) of bigger sizes (and also capacities) than in FIGS. 1 to 3*b* into the body 7 of the same outside diameters and with the same connecting means for sliding into the bracket 1, as the body 7 according to the examples on FIGS. 1 to 3*b* has, so it is possible to use a uniform bracket 1 for both "types" of the overvoltage protections in the bodies 7 of the same outside diameters.

The overvoltage protection according to this invention operates as follows.

The overvoltage protection carries out its function regularly if there is an occurrence of an overvoltage in the protected electric circuit, i.e., it lowers the overvoltage in the protected circuit down to an admissible value. However, due to aging and overloading, the properties of the protective element (nonlinear resistor element, varistor 8, a group of varistors, etc.) change. As a result, the current flowing through the protective member (varistor 8) increases, which causes increased temperature in the protective member (varistor 8). The thermal energy from the protective member (varistor 8) is naturally being led to the outlets 9 and 11. The outlet of the bottom electrode 9 of the varistor 8 gradually warms up.

The increased temperature of the bottom electrode 9 of the varistor 8 melts the solder that connects the outlet with the cable 10. As a result, this bond looses its rigidity, and the sliding member 4 shifts the end of the cable 10 towards the contact 5 by means of the pressure spring 15. As a result, it disconnects the outlet of the varistor 8 bottom electrode 9 from the cable 10 and thus also disconnects the protective member (varistor 8) from the mains. In the embodiment according to FIGS. 1 to 3*b*, the movement of the sliding member 4 does not affect the position of the lever 16 in the initial phase. The wall of sliding member 4*b*, however, ceases to retain the lever 16 in an unscreened position, and when the sliding member 4 moves further, the wall 4*c* of the sliding member 4 starts to act on the bottom arm 16*a* of the lever 16. The wall starts to turn the lever 16 on the stud 7*b*, and the indicator arm 16*b* screens the aperture 7*c* of the visual indication, changing the visual indication of the overvoltage protection state. In the embodiment according to FIGS. 4*a* and 4*b*, the shift of the sliding member 4 moves the bottom end 16*a* to move the lever 16. The indicator arm 16*b* of the lever 16 screens the visual indication aperture 7*c* to change the visual indication of the overvoltage protection status. In the embodiment according to FIGS. 5*a* and 5*b*, the shift of the sliding member 4 turns the lever 16 due to the stepped wall 4*d* of the sliding member 4, with which the bottom end 16*a* of the lever 16 is maintained in contact by means of the spring 16*c*. As a result of it, the indicator arm 16*b* of the lever 16 then screens the visual indication aperture 7*c* to change the visual indication of the overvoltage protection status. The movement of the sliding member 4 in all these examples also clears the space for the positioning element 3 to protrude and provide the remote indication of the change in the overvoltage protection status. The maintenance operator then easily finds, during the inspection of the overvoltage protection from the distance or in person, that the particular slide-in protective member 2 needs to be changed.

The invention is not limited only to herein explicitly described or shown embodiments, but modification of the principle with the suspended sliding member 4 acting on a low-melting bond of the cable 10 and one electrode of the protected element (varistor 8) in cooperation with visual and remote indication lies within the scope of mere professional skills of an ordinary expert in the art.

INDUSTRIAL APPLICABILITY

The invention is applicable in protecting electric circuits from an overvoltage condition.

The invention claimed is:

1. An overvoltage protection device, comprising:

a. a slide-in protective member;

b. at least one non-linear resistance element in the slide-in protective member;

c. a cable connected to the at least one non-linear resistance element by solder;

d. a sliding member biased against the cable, the sliding member capable of reciprocal movement in the slide-in protective member;

e. a visual indicator lever engaged with the sliding member so that movement of the sliding member moves the visual indicator; and f. a positioning element engaged with the sliding member so that movement of the sliding member moves the positioning element.

2. The overvoltage protection device of claim 1, wherein the sliding member includes a cavity at one end, and further including a spring in the cavity that biases the sliding member against the cable.

3. The overvoltage protection device of claim 1, wherein the sliding member includes a first wall and a second wall and the visual indicator includes a bottom arm between the first and second walls of the sliding member.

4. The overvoltage protection device of claim 1, wherein the visual indicator includes an indicator arm, and the slide-in protective member includes a visual indicator aperture, and the indicator arm at least partially covers the visual indicator aperture.

5. The overvoltage protection device of claim 1, wherein the sliding member includes a stepped wall, and the visual indicator is biased against the stepped wall by a spring.

6. The overvoltage protection device of claim 1, wherein the sliding member includes a stepped wall, and the positioning element engages with the stepped wall of the sliding member as the slide-in protective member rotates.

7. The overvoltage protection device of claim 1, wherein the slide-in protective further including an oval opening and identifying lugs.

* * * * *